United States Patent [19]

Allen

[11] 4,361,526

[45] Nov. 30, 1982

[54] THERMOPLASTIC COMPOSITE ROCKET PROPELLANT

[75] Inventor: Henry C. Allen, Decatur, Ala.

[73] Assignee: The United States of America as represented by the Secretary of the Army, Washington, D.C.

[21] Appl. No.: 272,859

[22] Filed: Jun. 12, 1981

[51] Int. Cl.[3] ..... C06B 21/00

[52] U.S. Cl. ..... 264/3 C; 264/3 R; 264/3 B; 149/19.9; 149/21; 149/42; 149/76; 149/109.6; 149/113

[58] Field of Search ..... 264/3 B, 3 C, 3 R; 149/19.9, 21, 42, 76, 109.6, 113

[56] References Cited

U.S. PATENT DOCUMENTS 3,879,504 4/1975 Sherman et al. ..... 264/3 C

*Primary Examiner*—Stephen J. Lechert, Jr.

*Attorney, Agent, or Firm*—Nathan Edelberg; Robert P. Gibson; Jack W. Voigt

[57] ABSTRACT

A process is disclosed by which thermoplastic elastomers may be utilized to prepare melt-formable composite rocket propellants. The thermoplastic elastomer is dissolved in a volatile organic solvent, the other propellant ingredients are mixed in, and the volatile organic solvent is evaporated. The dried propellant is melt-formed to final shape by molding or extruding above the melting point of the elastomer. An example of a usable thermoplastic elastomer is a block copolymer comprised of about 5 to about 20 weight percent styrene and of about 80 to 95 weight percent diene. The formed grain can be reclaimed by melting or dissolution in an organic solvent for reuse of the propellant ingredients.

4 Claims, No Drawings

THERMOPLASTIC COMPOSITE ROCKET PROPELLANT

DEDICATORY CLAUSE

The invention described herein may be manufactured, used, and licensed by or for the Government for governmental purposes without the payment to me of any royalties thereon.

BACKGROUND OF THE INVENTION

Composite solid rocket propellants consist of a rubbery matrix called a binder in which particles of solid oxidizing compounds are embedded. In addition to the oxidizer, the particulate solids of the propellant may include fuel elements, ballistic modifiers and/or other special-purpose solids. The binder consists of an elastomer which may or may not be plasticized with energetic or non-energetic dissolved liquids, and may contain other special-purpose dissolved liquid additives to impart particular ballistic or physical properties to the propellant.

Prior to the present invention, elastic composite propellants have derived their structural properties from elastomers which are chemically cross-linked. To prepare such a propellant, it is necessary to start with a liquid precursor of the elastomer, usually an oligomer in the 500–3000 average molecular weight range, in order to have the fluidity required for incorporating the other ingredients. After thoroughly mixing into this precursor all the other ingredients of the propellant, a curing agent is added which chemically reacts with the oligomer to convert it to an elastomer via chain extension and cross-linking. All processing and testing requiring propellant flow subsequent to addition of the curing agent, such as characterization tests and casting into rocket motors, must be accomplished in the period of time before the cure reaction renders the mixture unmanageably viscous. This period of time is termed the pot life. It is common in the industry that pot life strongly influences processing parameters, with a resulting impact on cost.

Once the binder of a composite propellant is cross-linked via the cure reaction, the propellant is very difficult to dispose of except by burning. Many military rockets reach obsolescence and require disposal of their propellant. Burning as a means of disposal is undesirable for environmental reasons as well as for the waste of materials which results.

It is apparent from the foregoing discussion that many problems associated with state-of-the-art composite propellants could be eliminated if the elastomeric properties of the binder did not require chemical cross-linking, but depended rather upon a thermally reversible physical phenomenon such as melting and crystallizing. Elastomers with this type of behavior have been available in recent years, known by such terms as thermoplastic elastomers. On the molecular level, such elastomers consist of hard segments, which are usually crystalline, and soft segments which are amorphous and which impart the rubbery properties of the material. Typical of such thermoplastic elastomers are block copolymers of monomers such as styrene and a diene, where the styrene blocks form the hard segments and the diene blocks form the soft or rubbery segments. There are various other types of thermoplastic elastomers as well.

The concept of utilizing thermoplastic elastomers as binders for composite propellants has been considered by the propulsion industry for many years. This is evidenced by the fact that virtually all new elastomers are considered as potential propellant binders as soon as they become known to the propulsion industry.

The approach of using thermoplastic elastomers for propellant binders has been centered around the conventional processing techniques which require processing by adding solids to the fluid fractions. However, in the course of attempts at using thermoplastic elastomers for binder ingredients by standard state-of-art processing techniques, artisans have concluded that it would be impractical if not impossible to mix solid particulates at the levels of interest into most thermoplastic elastomers while they are held above their melting points.

An object of this invention is to make the desires of the propellant industry become a reality by providing the combinations of techniques and formulations which enables thermoplastic elastomers to be utilized as the binders for composite propellants.

A further object of this invention is to overcome the obstacles of processing thermoplastic elastomers by providing a technique which employs the combination of thermoplastic elastomers in solution by common volatile organic solvents while processing.

Still a further object of this invention is to provide the technique of mixing the particulate solids of a composite propellant into a solution of a thermoplastic elastomer which technique overcomes the obstacles of the prior art processing technique while offering many advantages over the processing of composite propellants by conventional prior art techniques.

SUMMARY OF THE INVENTION

A thermoplastic elastomer is dissolved in an appropriate, volatile organic solvent, and the solid ingredients of the propellant formulation are added and mixed in. Special purpose binder ingredients may be used also. After these are thoroughly mixed together, the solvent is evaporated at such a time and in such a manner as is convenient for the processor.

The dried propellant, following solvent removal and drying, is a rubbery solid which can be divided into pellets or other form suitable for further processing. The pellets are used as a thermoplastic material in forming propellant grains in the melt phase by either pressing or extruding.

A typical thermoplastic elastomer useful in accordance with procedures of this invention is a block copolymer which is about 15 weight percent styrene and 85 weight percent isoprene. An appropriate volatile organic solvent is toluene.

DESCRIPTION OF THE PREFERRED EMBODIMENT

The process of this invention relates to the use of a thermoplastic elastomer as a composite propellant binder. The thermoplastic elastomer is dissolved in a volatile organic solvent, the particulate solids are added, and the solvent is subsequently removed to yield a rubbery composite solid propellant.

The following example illustrates a typical procedure for preparation of a composite propellant which utilizes a thermoplastic elastomer binder.

EXAMPLE 15.70 parts by weight of a block copolymer thermoplastic elastomer consisting of 15% styrene and 85% isoprene (sold under the trade name Kraton 1107) are mixed with 25 parts of toluene. The elastomer readily dissolves in a few minutes at 23° C. to form a clear, low-viscosity solution. Next, 0.30 parts of an aziridine compound is added to enhance the adhesive bond between the binder and the oxidizer particles. Then 16.00 parts of aluminum powder is added as a fuel element, and finally 68 parts of ammonium perchlorate (AP) as the oxidizer is added. Two different nominal particle sizes of AP are used to increase particle packing efficiency. After thoroughly mixing the solids with the elastomer solution, the mix is poured into a shallow tray and left exposed to ambient air to evaporate the toluene. After 3 days the odor of toluene could no longer be detected, and the mixture is a firm elastic composite propellant. The propellant is then chopped into pellets, and some of these pellets are placed in a mold and heated to 150° C., at which temperature they become a very viscous fluid. The propellant is pressed in a shaping mold and the mold is subsequently cooled with circulating water. The mold is opened and the propellant is found to be one solid block of rubbery composite propellant grain. The testing of the solid propellant grain yields results which indicates normal ballistic properties as compared with a chemically cured propellant grain having the same solids loadings. The measured mechanical properties compare favorably with a chemically cured formulation by having similar properties which are in an acceptable range.

The aziridine compound employed to enhance the bond between the binder and the oxidizer particles can be selected from BA114 which is formed from equal molar quantities of 12-hydroxystearic acid and tris[1-(2-methylaziridinyl)] phosphine oxide, other aziridine compounds, or other bonding agents such as those disclosed in U.S. Pat. Nos. 4,019,933 and 4,090,893 by Marjorie T. Cucksee and Henry C. Allen, which are employed to coat ammonium perchlorate and improve propellant properties.

Many thermoplastic elastomers are soluble in common organic solvents thereby obviating the problems faced by prior art techniques which attempted to use the thermoplastic elastomers by processing by conventional composite propellant processing procedures. Not only does the techniques of this invention for processing thermoplastic elastomers overcome the obstacles recognized by the prior art, but these techniques offer many advantages over the processing of composite propellant by conventional techniques. Some of these advantages are:

1. The viscosity of the mix can be readily controlled by the amount of solvent used. In processing conventional propellants, mix viscosity is strongly influenced by the amount of solid matter included, and by the particle sizes of the solids; many desirable formulations are extremely difficult to mix, and some cannot be processed at all. With solutions of thermoplastic elastomeric binders, these formulations can be mixed easily by adjusting the level and type of binder solvent.

2. Thermoplastic propellant mixes having the binder in solution have unlimited pot life. Since no chemical cure reaction is occurring, the fluid propellant mix can be held indefinitely without change. This enables complete characterization of a mix before it is committed to its final use. Further, mixes can be blended into larger batches to get greater quantities with uniform properties. Formulation adjustments can be made in process if needed. Propellants can be made in advance, when mixing facilities may otherwise be idle, and stored until needed. There are many other advantages to unlimited pot life as well.

3. Due to the low viscosity of the binder solution, mixing time is short and power demand is low.

The advantages of thermoplastic propellants are by no means limited to mixing. The fluid propellant mix would usually be stripped of solvent before final forming. Stripping or removal of the solvent can be accomplished in a variety of ways, depending upon the processor's wishes and the form most suitable for final processing. One technique which has been found to be convenient includes drying the propellant as rods or sheets which may then be cut into pellets or shredded into a crumb form. In this dried form the propellant once again has been found to have advantages over conventional composite propellants. It may be held indefinitely, it may be blended to adjust properties or achieve uniformity, or it may be re-dissolved for formulation adjustment or other purposes. Loss as waste is virtually eliminated since the propellant scraps, the test specimens (other than those which are consumed, such as burn rate samples) can be reprocessed simply by remelting or re-dissolving.

The thermoplastic nature of these propellants is critical to the final forming of propellant grains from the pellets or other forms which have been prepared from the dried propellant. When heated above the melting point of the thermoplastic elastomer, the propellant becomes a very viscous fluid. It can then be formed by pressing in molds or by extruding through dies. Upon cooling it again becomes a firm, rubbery material with properties quite similar to those of propellants made with chemically cross-linked binders. Many ways of forming the propellant into final configuration will be apparent to those skilled in the art, including the pressing of melted propellant into rocket motor cases to form case-bonded grains.

Thermoplastic propellants have certain unique properties which enhance their desirability as rocket propellants. They can be solvent bonded, which will enable repair of damaged grains and the construction of complex grain designs which cannot be cast or molded. Surfaces can also be joined in the melt phase. They can be removed from the motor cases either by dissolution or by melting. The propellant from motors no longer needed thus may be re-used, or the raw materials may be reclaimed.

I claim:

1. A process for utilizing a thermoplastic elastomer as a binder for a composite propellant composition and for forming a solid propellant grain of same, said process comprising:

(i) providing a thermoplastic elastomer which consists of hard segments having substantially crystalline properties and soft segments having substantially amorphous properties, said hard segments imparting rigid properties to a solid propellant composition with which it is combined, and said soft segments imparting rubbery properties to a solid propellant composition with which it is combined;

(ii) dissolving said thermoplastic elastomer in an excess amount of a volatile organic solvent;

(iii) adding and mixing an aziridine compound as a bonding agent in said dissolved thermoplastic elastomer to enhance the adhesive bond between the binder material and propellant composition solids;

(iv) continue adding and mixing into said dissolved thermoplastic elastomer, propellant solids including aluminum powder as a fuel element and two different nominal particle sizes of ammonium perchlorate as oxidizer to increase particle packing efficiency;

(v) continue mixing said solids in said thermoplastic elastomer solution to achieve a uniform mixture of said composite propellant composition;

(vi) evaporating said organic solvent from said composite propellant composition to yield a dry solid composite propellant composition free from said volatile organic solvent;

(vii) chopping said dried solid composite propellant composition into pellets;

(viii) placing a predetermined amount of said pellets in a mold and heating to 150° C. to yield a viscous fluid of said solid composite propellant composition;

(ix) pressing said viscous fluid in said mold; and, (x) cooling said mold and releasing from said mold a formed solid composite propellant grain.

2. The process of claim 1 wherein said volatile organic solvent is toluene and said thermoplastic elastomer is a block copolymer of styrene and a diene, said styrene comprising from about 5 weight percent to about 20 weight percent of said thermoplastic copolymer with balance weight percent of said thermoplastic elastomer comprised of said diene.

3. The process of claim 1 which additionally includes the step of reclaiming said solid composite propellant grain by melting.

4. The process of claim 1 which additionally includes the step of reclaiming said solid composite propellant grain by dissolving in a volatile organic solvent.

* * * * *